US009728151B2

(12) United States Patent
Chang

(10) Patent No.: US 9,728,151 B2
(45) Date of Patent: Aug. 8, 2017

(54) DISPLAY PANEL DRIVING AND SCANNING METHOD AND SYSTEM

(71) Applicant: ORISE TECHNOLOGY CO., LTD., Hsinchu (TW)

(72) Inventor: Chia-Fu Chang, Taichung (TW)

(73) Assignee: FOCALTECH SYSTEMS CO., LTD., Hsinchu (TW)

( * ) Notice: Subject to any disclaimer, the term of this patent is extended or adjusted under 35 U.S.C. 154(b) by 427 days.

(21) Appl. No.: 13/893,455

(22) Filed: May 14, 2013

(65) Prior Publication Data

US 2013/0321365 A1 Dec. 5, 2013

(30) Foreign Application Priority Data

May 30, 2012 (TW) ..... 101119318 A

(51) Int. Cl.
*G09G 5/00* (2006.01)
*G09G 3/36* (2006.01)

(52) U.S. Cl.
CPC ..... *G09G 3/3674* (2013.01); *G09G 3/3692* (2013.01); *G09G 2320/0252* (2013.01); *G09G 2320/0257* (2013.01); *G09G 2340/16* (2013.01)

(58) Field of Classification Search
CPC .. G09G 3/18; G09G 3/22; G09G 3/34; G09G 3/3406; G09G 3/36–3/3696
USPC ..... 345/102, 204–215
See application file for complete search history.

(56) References Cited

U.S. PATENT DOCUMENTS

| | | | | |
|---|---|---|---|---|
| 6,693,618 | B2 | 2/2004 | Son et al. | |
| 8,013,829 | B2 | 9/2011 | Chen et al. | |
| 2005/0219409 | A1* | 10/2005 | Cheng | 348/448 |
| 2007/0132683 | A1* | 6/2007 | Kong | 345/87 |
| 2008/0018587 | A1* | 1/2008 | Honbo et al. | 345/102 |
| 2013/0100101 | A1* | 4/2013 | Li | G02F 1/29 345/211 |

* cited by examiner

*Primary Examiner* — Hang Lin
(74) *Attorney, Agent, or Firm* — Bacon & Thomas, PLLC

(57) ABSTRACT

A display panel driving and scanning system includes a timing controller to divide one frame period into first to third time periods. In the first time period, an image processing device calculates an overdriving signal for a current frame based on the current frame and a previous frame. In the second time period, the image processing device outputs the current frame, and a source driver charges the capacitors of the pixels in the liquid crystal display panel based on the current frame. In the third time period, the timing controller drives a backlight driving circuit to turn on a backlight source of the liquid crystal display panel for displaying the current frame.

6 Claims, 8 Drawing Sheets

DISPLAY PANEL DRIVING AND SCANNING METHOD AND SYSTEM

CROSS REFERENCE TO RELATED APPLICATION

This application claims the benefits of the Taiwan Patent Application Serial Number 101119318, filed on May 30, 2012, the subject matter of which is incorporated herein by reference.

BACKGROUND OF THE INVENTION

1. Field of the Invention

The present invention relates to the technical field of display panels and, more particularly, to a display panel driving and scanning method and system.

2. Description of Related Art

FIG. 1 is a schematic diagram of a typical display panel driving method. As shown in FIG. 1, the driving scheme sequentially activates scanning signals in one frame period. For example, it starts to scan sequentially from the first line L1 to the last line Ln. For each line to be activated, the data to be displayed is written in the display panel through the data channels (S1-Sm). At this moment, the display panel can follow the scanning sequence to sequentially display the input data, so that the full frame is displayed immediately when the scanning completely ends.

The panel display driving method in the prior art may encounter one special problem in actual application. Namely, the displayed data between the tandem scanning lines has one frame time difference, which can easily cause a flicker on visual effect and further produce a smearing effect.

In comparison with a liquid crystal display (LCD) panel and a conventional cathode ray tube (CRT) screen, the smearing effect on a frame of the LCD panel is one of most disadvantages for the LCD. The currently popular liquid crystal response time can reach above 8 ms, but the liquid crystals somewhat have a certain degree of smearing.

The signal responses in many prior arts are gradually shortened to 5 ms, 4 ms, 2 ms, or even 1 ms. However, when the LCD panel displays a high-speed motion frame, the smearing phenomenon still appears. Thus, the smearing phenomenon on the liquid crystals is a serious problem to be overcome.

For a further description, there are two factors that may cause the smearing phenomenon. The first factor is that, in view of the liquid crystal operation principle, each pixel point on an LCD frame uses the twisted nematic liquid crystal molecules to control the intensity of an irradiated light. The irradiated light is outputted by a backlight source that is in a lighting state all the time. The LCD panel presents a so-called "hold-type" display for the pixel signals since the viscous liquid crystal molecules are difficult to completely block a pierced light, the backlight source is open all the time, and so on. That is, the continuity of each interval between the signals is stronger, which can allow the human eyes to sensitively capture a "memorized" previous frame in a rapidly switching frame process due to the visual staying phenomenon to thus overlap or mix with a newly presented frame, or more seriously produce the smearing phenomenon.

The second factor is that the visual staying phenomenon of human eyes also causes the smearing phenomenon. Since the vision of human eyes remains an object's image for a while after the object disappears, the visual staying phenomenon can cause the human eyes to have the smearing of a frame even though the LCD response time is very fast.

The current response time is reduced to 1 ms at most, which is done by precisely controlling the driving voltage of a display so as to shorten the response time between the gray levels. However, the smearing phenomenon or afterimage still exists even the response time is shortened to the limit.

Accordingly, for the liquid crystal smearing phenomenon, a typical black frame insertion technology is used to eliminate the phenomenon. A black frame is periodically inserted between two frames, so as to avoid the blurring effect on the edges that is caused by the special imaging mechanism of human eyes in frame switching, and further eliminate the liquid crystal smearing phenomenon. Since the human eyes have the visual staying phenomenon, the black frame inserted between the two frames by the black frame insertion technology can cancel the visual staying time of the human eyes and eliminate the liquid crystal smearing phenomenon.

U.S. Pat. No. 6,693,618 granted to Son, et al. for a "Liquid crystal display device and driving method for the same" has disclosed a black frame insertion. Namely, it divides each frame into two subframes for displaying the image data and the black frames to thereby reduce the image display time and improve the afterimage of an LCD. However, such a black frame insertion has to completely display the current frame and the black frame in an original frame display time, resulted in increasing the frequency of the driving clock CLK. Thus, the power consumption of the TFT LCD 10 is correspondingly increased to disadvantage the utilities of the portable electronic devices. In addition, the typical black frame insertion is a frame-based process, and an uneven frame may occur when the original frame and the black frame do not have a ratio of 1:1. Besides, the backlight source is turned on all the time when the black frame insertion is operated, resulted in consuming much power.

U.S. Pat. No. 8,013,829 granted to Chen, et al. for a "Liquid crystal display having black insertion controller selecting black insertion control signals according to data stored therein and driving method thereof" has disclosed a black insertion controller. In this case, one frame period T0 is divided into a first subframe period T1 and a second subframe period T2. FIG. 2 is a schematic diagram of a typical LCD panel scanning timing. As shown in FIG. 2, the liquid crystals are driven to display a normal image unit or a black image unit in the first subframe period T1 according to an address, and the liquid crystals are driven to convert the normal image unit into a black image unit or convert the black image unit into a normal image unit in the second subframe period T2 to thereby improve the smearing phenomenon. However, although the liquid crystal smearing phenomenon can be alleviated, it cannot be completely eliminated. In addition, in the frame period T0, the backlight source needs to be turned on all the time, which consumes much power.

Therefore, it is desirable to provide an improved display panel driving and scanning method and system to mitigate and/or obviate the aforementioned problems.

SUMMARY OF THE INVENTION

The object of the present invention is to provide a display panel driving and scanning method and system, which can eliminate the smearing phenomenon of an LCD panel and increase the image definition to thereby reduce the power consumption in a portable device and prolong the usage lifetime.

According to a feature of the invention, a display panel driving and scanning system is provided, which is used in a liquid crystal display (LCD) panel to drive pixels of the LCD panel for displaying an image. The LCD panel has a plurality of scan lines arranged in rows, a plurality of source lines arranged in columns across the scan lines, and a plurality of pixels each arranged at an intersection of the scan lines and the source lines. The system comprises: a scan driver connected to the LCD panel through the scan lines for providing a scan driving signal to the LCD panel; a source driver connected to the LCD panel through the source lines for providing an image display signal to the LCD panel; an image processing device connected to the source driver for storing a previous frame and receiving a current frame, so as to calculate an overdriving signal for the current frame based on the previous frame and the current frame; and a timing controller connected to the scan driver, the source driver, and the image processing device for controlling the scan driver, the source driver, and the image processing device to produce corresponding signals for displaying the current frame on the LCD panel, wherein the image processing device outputs the overdriving signal and the current frame respectively for charging the plurality of pixels in one frame period, and the frame period is divided into a first time period, a second time period, and a third time period, such that the image processing device outputs the overdriving signal in the first time period for charging the plurality of pixels and outputs the current frame in the second time period for charging the plurality of pixels.

According to another feature of the invention, a display panel driving and scanning method is provided, which is used in a liquid crystal display (LCD) panel to drive pixels of the LCD panel for displaying an image. The LCD panel has a plurality of scan lines arranged in rows, a plurality of source lines arranged in columns across the scan lines, and a plurality of pixels each arranged at an intersection of the scan lines and the source lines. The method comprises the steps of: (A) dividing one frame period into a first time period, a second time period, and a third time period; (B) in the first time period, calculating an overdriving signal for the current frame based on a previous frame and a current frame, and outputting the overdriving signal; (C) in the second time period, outputting the current frame and charging the plurality of pixels based on the current frame; and (D) in the third time period, driving a backlight driving circuit for turning on a backlight source of the LCD panel and displaying the current frame.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
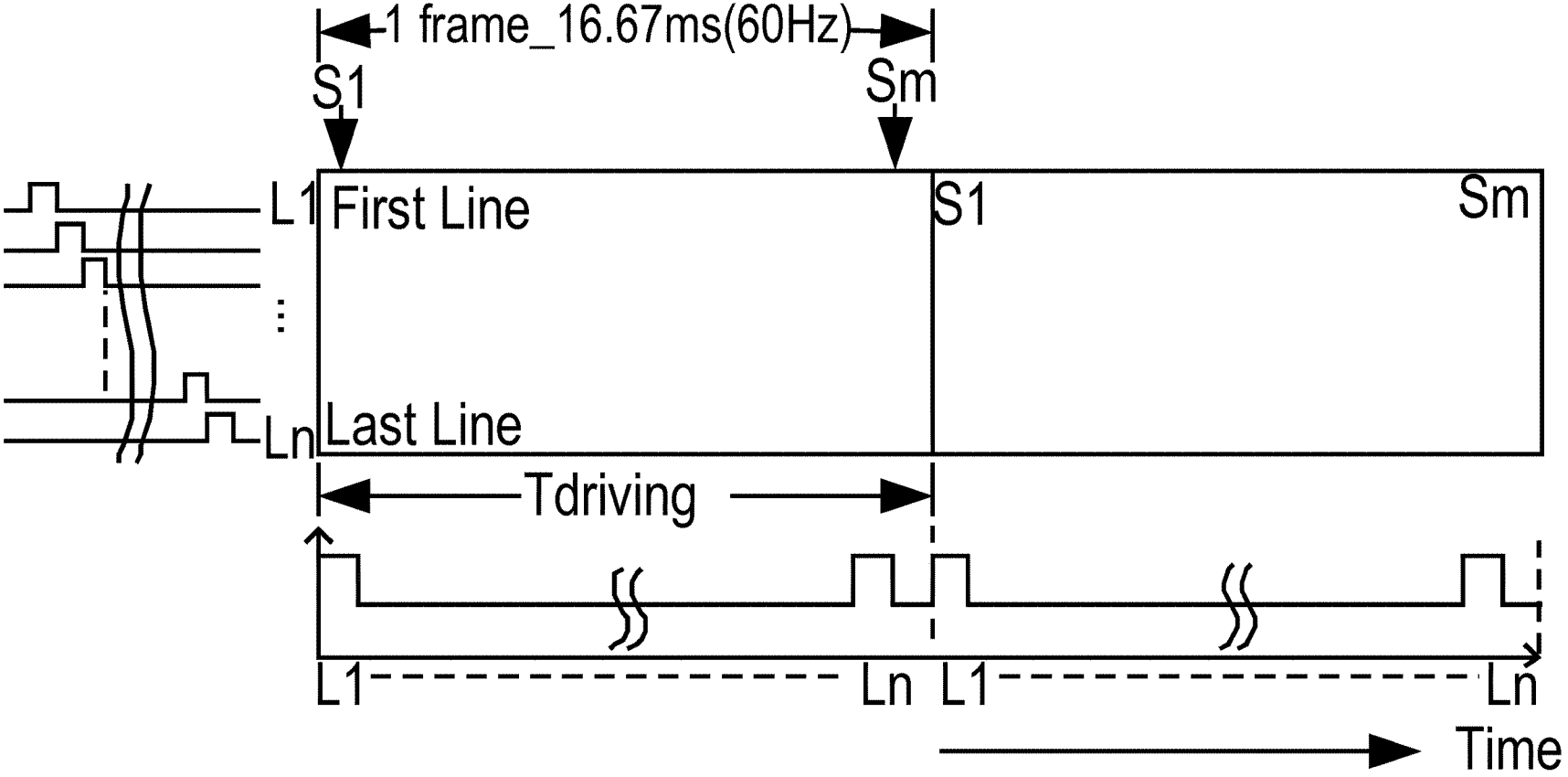
FIG. 1 (Prior Art)
FIG. 1 is a schematic diagram illustrating a typical display panel driving principle.
Figure 2:
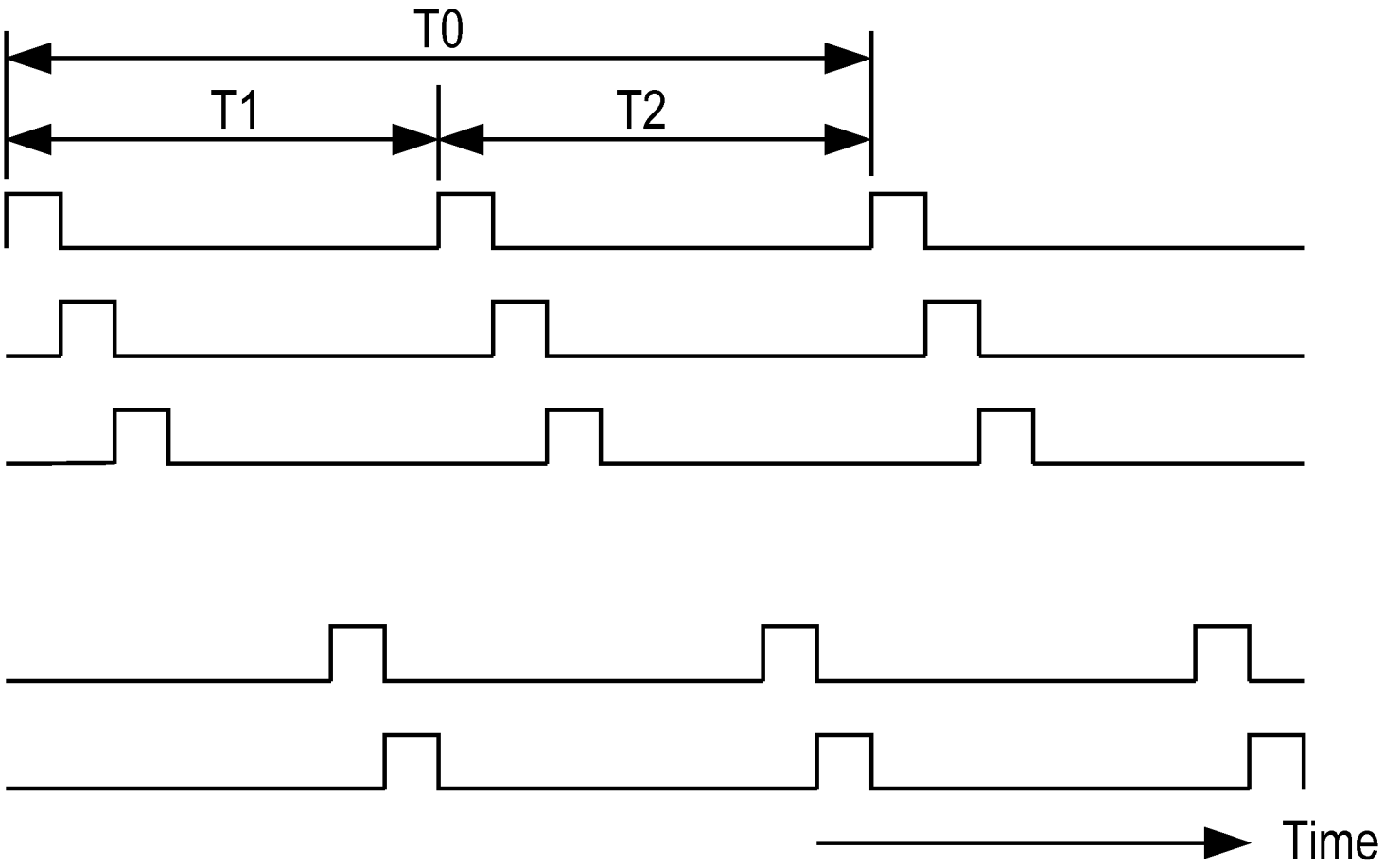
FIG. 2 (Prior Art)
FIG. 2 is a schematic diagram of a typical LCD panel scanning timing.
Figure 3:
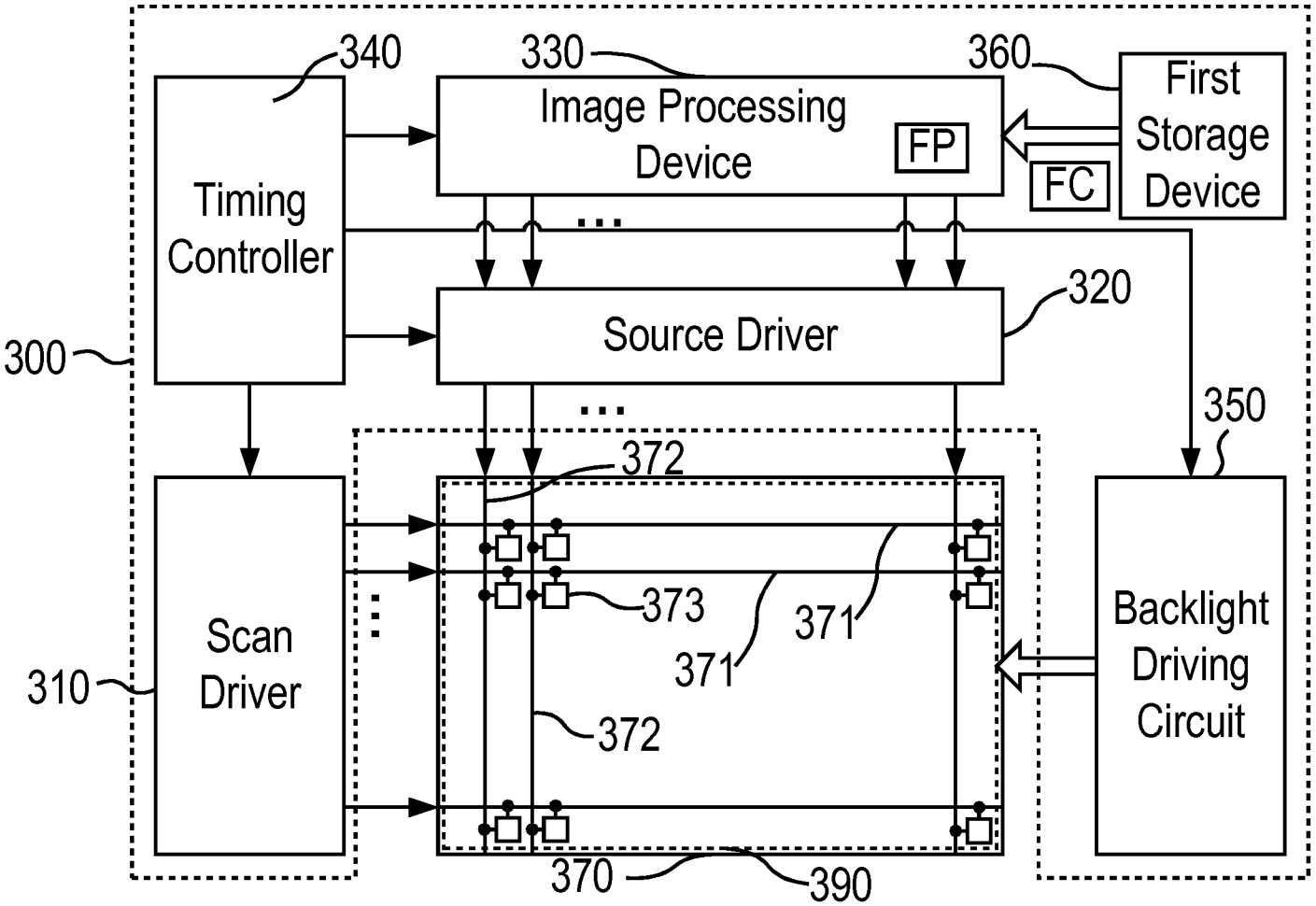
FIG. 3 is a block diagram of a display panel driving and scanning system in accordance with the present invention.

FIG. 3 is a block diagram of a display panel driving and scanning system 300 in accordance with an embodiment of the present invention. The system 300 is used in an LCD panel 370 to drive the pixels 373 of the panel 370 for displaying an image. The LCD panel 370 has a plurality of scan lines 371, a plurality of source lines 372, a plurality of pixels 373, and a backlight source 390. The scan lines 371 are arranged in rows, and the source lines 372 are arranged in columns across the scan lines 371. Each of the pixels 373 is arranged at an intersection of the scan lines 371 and the source lines 372. The backlight source 390 provides a light source required for the panel 370. As shown in FIG. 3, the system 300 includes a scan driver 310, a source driver 320, an image processing device 330, a timing controller 340, a backlight driving circuit 350, and a first storage device 360.

The scan driver 310 is connected to the LCD panel 370 through the scan lines 371 in order to provide a scan driving signal to the LCD panel 370.

The source driver 320 is connected to the LCD panel 370 through the source lines 372 in order to provide an image display signal to the LCD panel 370.

The image processing device 330 stores a previous frame FP and is connected to the source driver 320 in order to receive a current frame FC and calculate an overdriving signal for the current frame FC based on the previous frame FP and the current frame FC.

The timing controller 340 is connected to the scan driver 310, the source driver 320, the image processing device 330, and the backlight driving circuit 350 in order to control the scan driver 310, the source driver 320, the image processing device 330, and the backlight driving circuit 350 to produce corresponding signals for displaying the current frame FC on the LCD panel 370.

The backlight driving circuit 350 is connected to the timing controller 340 and the LCD panel 370. The timing controller 340 controls the backlight driving circuit 350 to drive the backlight source 390 of the LCD panel 370.

In one frame period TFrame, the image processing device 330 outputs the overdriving signal and the current frame FC respectively to thereby charge the capacitors (not shown) of the pixels 373. The frame period TFrame is divided into a first time period T1, a second time period T2, and a third time period Tb. In the first time period T1, the image processing device 330 outputs the overdriving signal to thereby charge the capacitors of the pixels 373. In the second time period T2, the image processing device 330 outputs the current frame FC to thereby charge the capacitors of the pixels 373.

In the third time period Tb, the timing controller 340 controls the backlight driving circuit 350 to drive the backlight source 390 of the LCD panel 370 for producing a backlight and further displaying the current frame FC. In the first time period T1 and the second time period T2, the timing controller 340 drives the backlight driving circuit 350 to turn off the backlight source 390 of the LCD panel 370. In the third time period Tb, the timing controller 340 drives the backlight driving circuit 350 to turn on the backlight source 390 of the LCD panel 370 for displaying the current frame FC.

Figure 4:
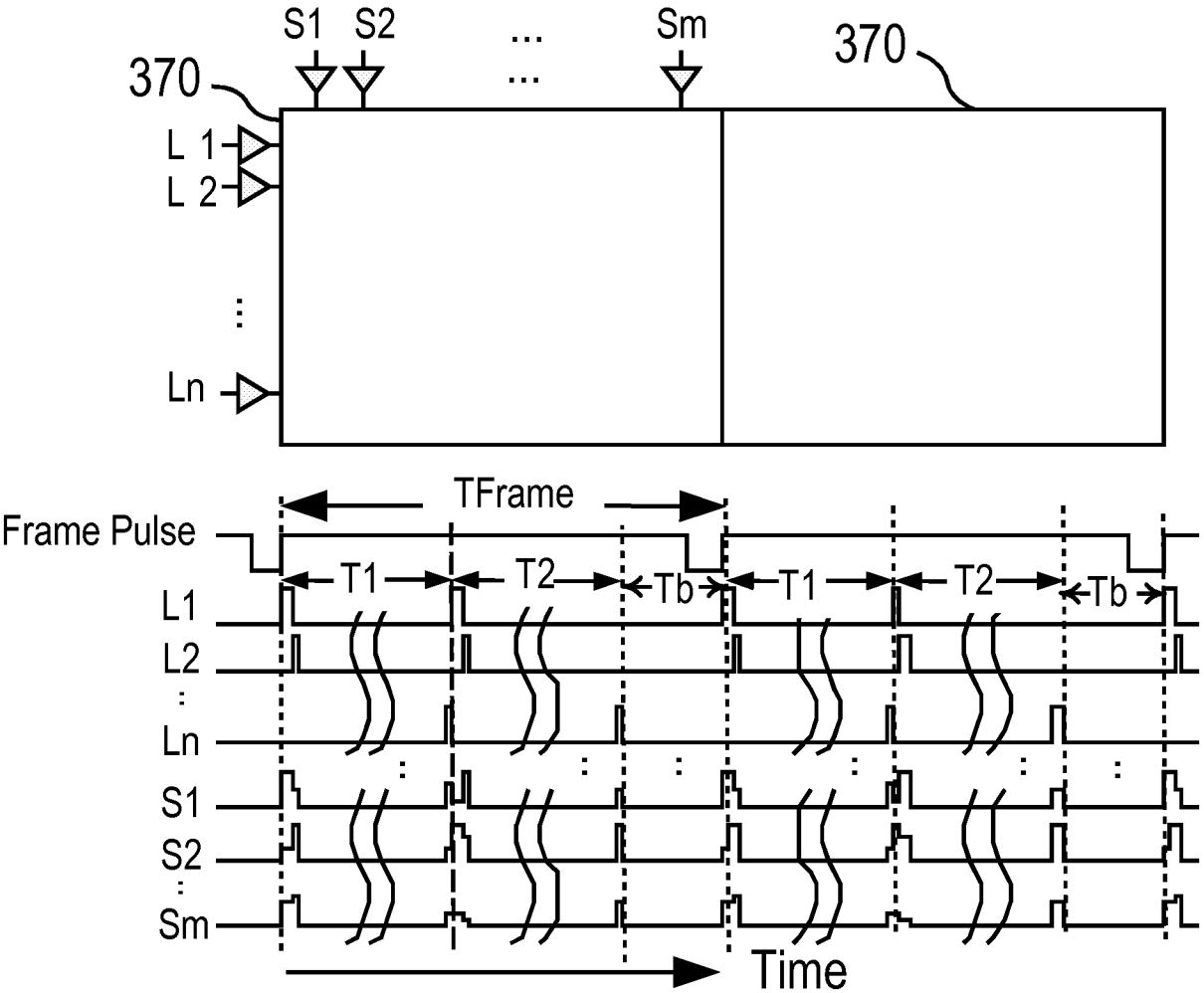
FIG. 4 is a timing diagram of a display panel driving and scanning system in accordance with the present invention.

FIG. 4 is a timing diagram according to the invention. In FIG. 4, the Frame Pulse signal indicates one frame cycle, i.e., one frame period TFrame(ms) is between two Frame Pulse signals. In addition, L1, L2, . . . , Ln indicate the scan lines on the LCD panel 370, where 240 scan lines (L1-L240) are included in a display panel in case of having the resolution of 320(H)×240(V) pixels. The scanning time is defined to turn on the scan lines from L1 to Ln sequentially. S1-Sm indicate the source lines, where 320 source lines (S1-S320) are included in the display panel with the resolution of 320(H)×240(V) pixels. The time interval Tb indicates the length of no scanning operation, i.e., Tb=TFrame−(T1+T2), where T1+T2 indicates the length of scanning operation. For example, if the LCD panel 370 has a resolution of 320(H)×240(V) and the frame rate is 60 Hz, we have TFrame=16.67 ms, T1=5 ms, T2=5 ms, and Tb=6.67 ms.

The first storage device 360 is connected to the image processing device 330 in order to temporarily store the current frame FC.

Figure 5:
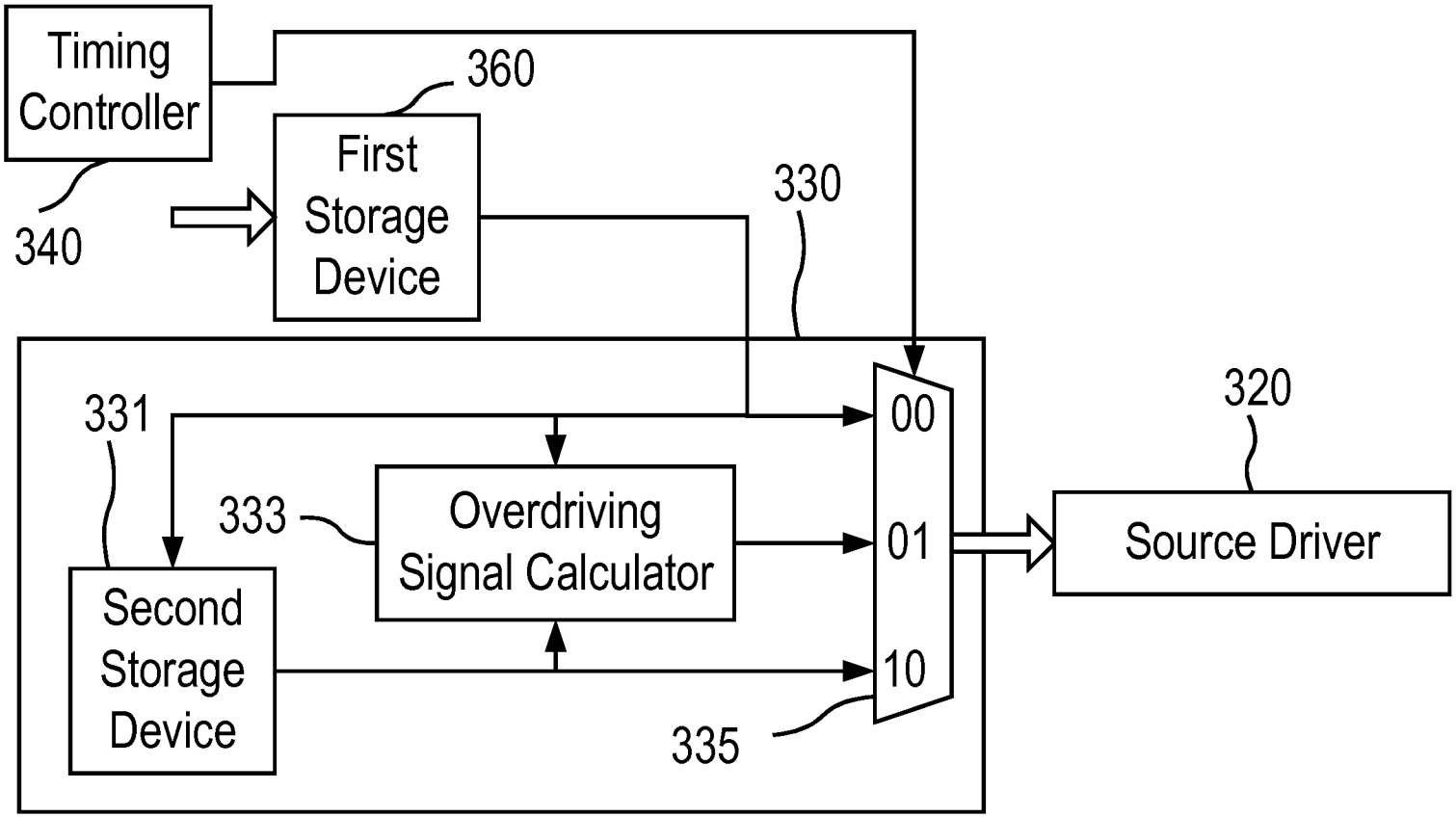
FIG. 5 is a block diagram of an image processing device in accordance with the present invention.

FIG. 5 is a block diagram of the image processing device 330 in accordance with the present invention. In FIG. 5, the image processing device 330 includes a second storage device 331, an overdriving signal calculator 333, and a multiplexer 335.

The second storage device 331 is connected to the first storage device 360 in order to receive a frame that currently exists in a previous frame period and is defined as a current frame in that previous frame period or a previously current frame, and temporarily store it as the previous frame FP.

The overdriving signal calculator 333 is connected to the first storage device 360 and the second storage device 331 in order to calculate the overdriving signal for the current frame FC based on the current frame FC and the previous frame FP.

The multiplexer 335 is connected to the first storage device 360, the second storage device 331, and the timing controller 340 in order to output the overdriving signal or the current frame FC.

Figure 6:
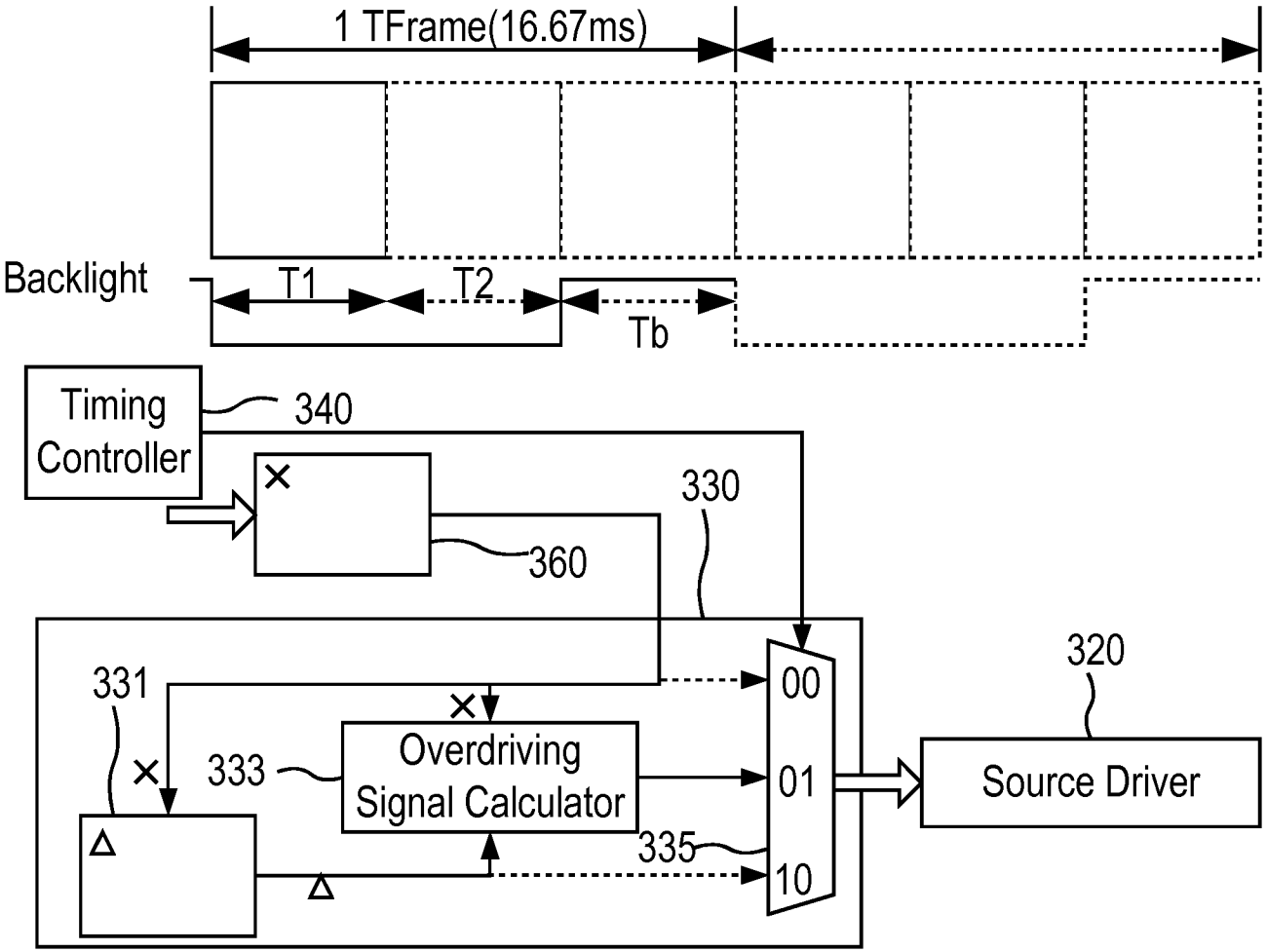
FIG. 6 is a schematic diagram of an operation of the image processing device of FIG. 5 in accordance with the present invention.

FIG. 6 is a schematic diagram of an operation of the image processing device 330 of FIG. 5 in accordance with the present invention. As shown in FIG. 6, in the first time period T1, the first storage device 360 outputs a pixel (x) of a current frame FC and the second storage device 331 outputs a pixel (Δ) of a previous frame FP at a corresponding position to the pixel (x). The overdriving signal calculator 333 is based on the pixel (x) of the current frame FC and the pixel (Δ) of the previous frame FP to calculate the overdriving signal at the corresponding position. In this case, the timing controller 340 configures the multiplexer 335 to output the overdriving signal. Moreover, the designer is based on the factors including the resolution of the panel, the delay of the overdriving signal calculator 333, the delay of a transmission path, and the like to design the circuits required for the timing controller 340 to thereby achieve the synchronization. The pixel (x) is written in the second storage device 331 to replace the pixel (Δ) for use as the pixel of the previous frame FP to calculate a next overdriving signal.

The overdriving signal has a voltage slightly higher than the voltage corresponding to the pixel (x). In the second time period T2 immediately after the time period (T1), the voltage of the overdriving signal is reduced to the voltage corresponding to the pixel (x). The liquid crystals can have a quicker transition to increase the response speed since the overdriving signal has the slightly higher voltage.

Figure 7:
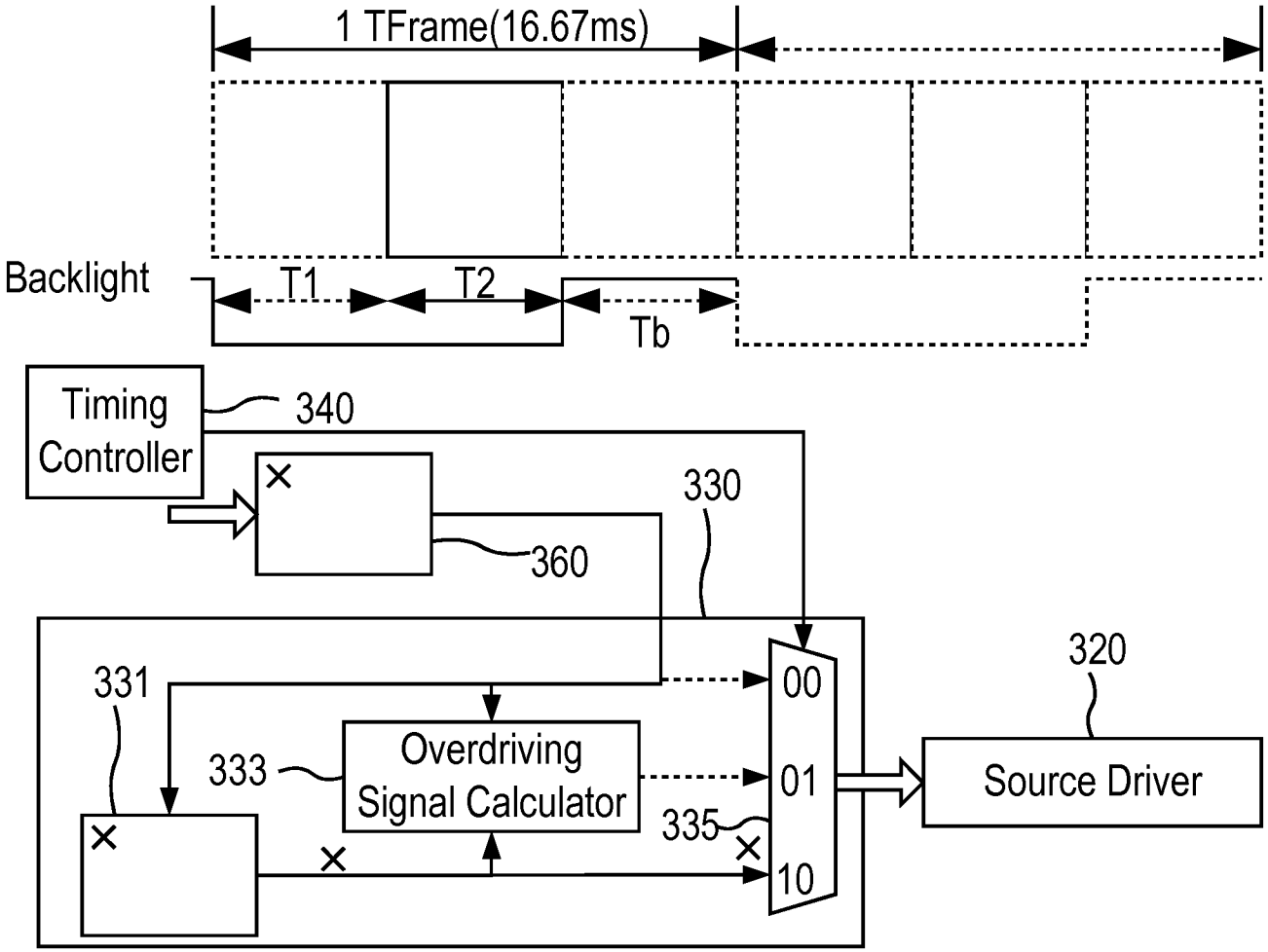
FIG. 7 is a schematic diagram of another operation of the image processing device of FIG. 5 in accordance with the present invention.

As shown in FIG. 7, in the second time period T2, the timing controller 340 configures the multiplexer 335 to output the pixel (x) of the current frame FC of the second storage device 331 that is stored in the first time period T1.

In the third time period Tb, the timing controller 340 drives the backlight driving circuit 350 to turn on the backlight source 390 of the LCD panel 370 for further displaying the current frame FC.

The timing controller 340 can configure the multiplexer 335 to output the current frame FC of the first storage device 360 to thereby turn off the image processing device 330.

Figure 8:
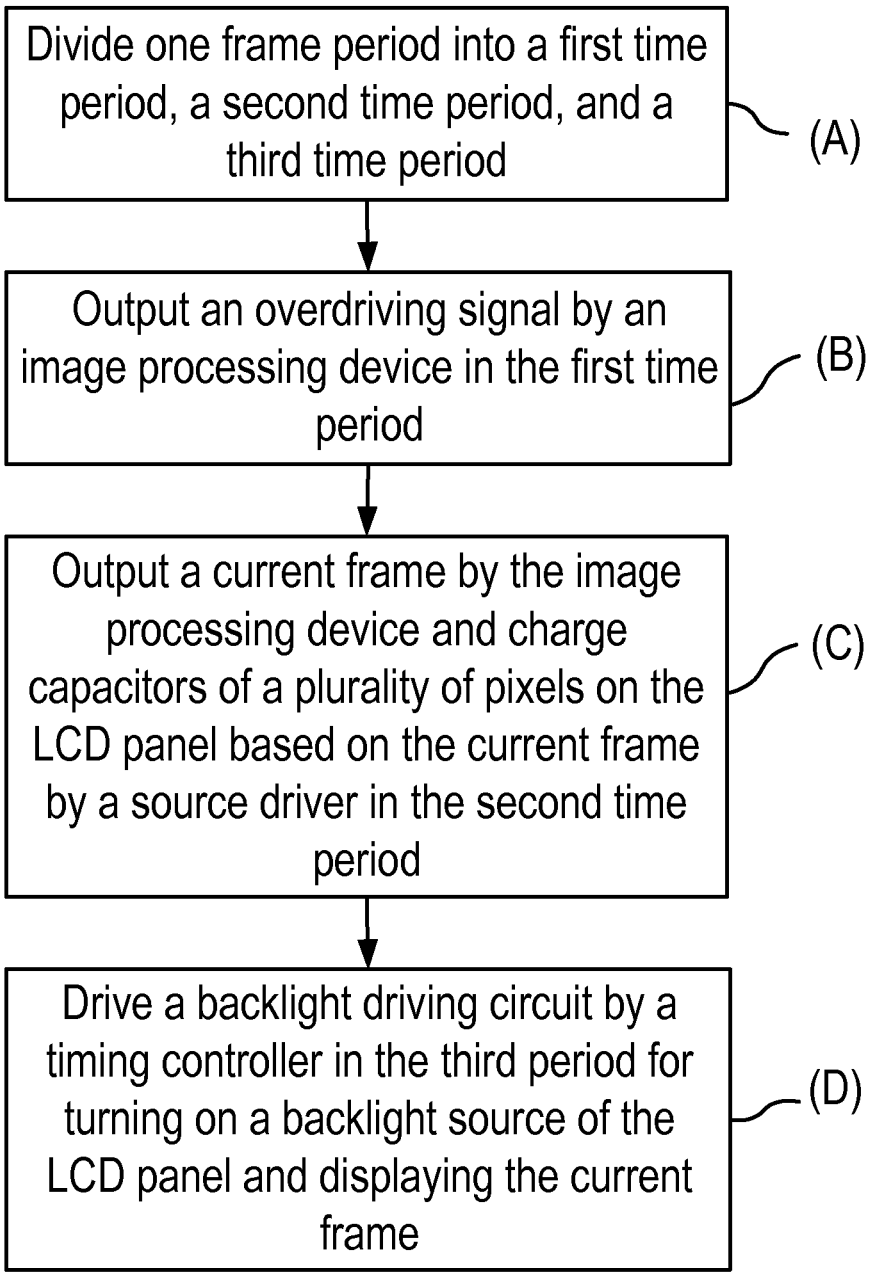
FIG. 8 is a flowchart of a display panel driving and scanning method in accordance with the present invention.

FIG. 8 is a flowchart of a display panel driving and scanning method in accordance with the present invention. As shown in FIG. 8, at step (A), the timing controller 340 divides one frame period into a first time period T1, a second time period T2, and a third time period Tb.

At step (B), in the first time period T1, the image processing device 330 is based on a current frame FC and a previous frame FP to calculate an overdriving signal for the current frame FC and output the overdriving signal.

At step (C), in the second time period T2, the image processing device 330 outputs the current frame FC, and the source driver 320 is based on the current frame FC to charge the capacitors of the pixels 373 of the LCD panel 370.

At step (D), in the third time period Tb, the timing controller 340 drives the backlight driving circuit 350 to turn on the backlight source 390 of the panel 370 for further displaying the current frame FC.

As cited, the display panel driving and scanning system of the present invention can increase the scanning speed so as to completely scan the display panel earlier than one frame period and also increase the number of scanning, i.e., over two times. Since the scanning is complete earlier and the time interval Tb in which no scanning is operated is remained, the display frame can be displayed immediately after a quick refresh and remains for a while to thereby avoid the human eyes from sensing the flicker effect. In addition, the backlight source 390 is turned on only in the time interval Tb, which can save more power than the prior art. In the first time period T1, the source driver 320 is based on the overdriving signal output by the image processing device 330 to charge the capacitors of the pixels 373 of the panel 370, so as to further increase the response time of the liquid crystals. In the second time period T2, the source driver 320 is based on the current frame output by the image processing device 330 to charge the capacitors of the pixels 373 of the LCD panel 370 so as to display the current frame when the backlight 390 is turned on in the time interval Tb. It is noted that the function of black frame insertion can work well since the backlight source 390 is not turned on in the first time period T1 and the second time period T2.

Although the present invention has been explained in relation to its preferred embodiment, it is to be understood that many other possible modifications and variations can be made without departing from the spirit and scope of the invention as hereinafter claimed.

What is claimed is:

1. A display panel driving and scanning system, which is used in a liquid crystal display (LCD) panel to drive pixels of the LCD panel for displaying an image, the LCD panel having a plurality of scan lines arranged in rows, a plurality of source lines arranged in columns across the scan lines, and a plurality of pixels each arranged at an intersection of the scan lines and the source lines, the display panel and scanning system comprising:

a scan driver, connected to the LCD panel through the scan lines, for providing a scan driving signal to the LCD panel;

a source driver, connected to the LCD panel through the source lines, for providing an image display signal to the LCD panel;

an image processing device, connected to the source driver, for storing a previous frame and receiving a current frame, so as to calculate an overdriving signal for the current frame based on the previous frame and the current frame, and a timing controller, for controlling the scan driver, the source driver, and the image processing device to display the current frame on the LCD panel, wherein the image processing device outputs the overdriving signal and the current frame respectively for charging the plurality of pixels in one frame period, and the frame period is divided into a first time period, a second time period, and a third time period, such that the image processing device outputs the overdriving signal in the first time period for charging the plurality of pixels, stops outputting the overdriving signal and outputs the current frame in the second time period for charging the plurality of pixels based on the current frame, and stops outputting the current frame in the third time period;

wherein the image processing device comprises:

a first storage device for temporarily storing the current frame;

a second storage device, connected to the first storage device, for receiving the current frame in a previous frame period and temporarily storing it as the previous frame;

an overdriving signal calculator, connected to the first storage device and the second storage device, for calculating the overdriving signal for the current frame based on the current frame stored in the first device and the previous frame stored in the second storage device; and a multiplexer, connected to the first storage device, the second storage device, and the timing controller, for outputting the overdriving signal and the current frame according to an input signal from the timing controller.

2. The display panel driving and scanning system as claimed in claim 1, wherein the third time period has a length determined by subtracting the first time period and the second time period from the frame period.

3. The display panel driving and scanning system as claimed in claim 2, further comprising a backlight driving circuit, connected to the timing controller and the LCD panel, for driving a backlight source of the LCD panel by the timing controller.

4. The display panel driving and scanning system as claimed in claim 3, wherein the timing controller in the third time period controls the backlight driving circuit to drive the backlight source of the LCD panel for displaying the current frame.

5. The display panel driving and scanning system as claimed in claim 1, wherein in the first time period, the first storage device outputs a pixel of the current frame and the second storage device outputs pixel of the previous frame at a corresponding position to the pixel of the current frame, such that the overdriving signal calculator calculates the overdriving signal at the corresponding position according to the pixel of the current frame and the pixel of the previous frame.

6. The display panel driving and scanning system as claimed in claim 5, wherein the timing controller configures the multiplexer to output the overdriving signal in the first time period.

* * * * *